US005957743A

United States Patent [19]

Konishi et al.

[11] Patent Number: 5,957,743

[45] Date of Patent: Sep. 28, 1999

[54] MANUFACTURING PROCESS FOR COLOR PLASMA DISPLAY PANELS

[75] Inventors: Tsuneo Konishi; Keiji Nunomura, both of Tokyo, Japan

[73] Assignee: NEC Corporation, Tokyo, Japan

[21] Appl. No.: 08/969,416

[22] Filed: Oct. 21, 1997

[30] Foreign Application Priority Data

Oct. 23, 1996 [JP] Japan ..... 280821

[51] Int. Cl.[6] ..... H01J 17/49

[52] U.S. Cl. ..... 445/24; 313/587

[58] Field of Search ..... 445/24; 313/584, 313/586, 587

[56] References Cited

U.S. PATENT DOCUMENTS 5,541,479 7/1996 Nagakubo ..... 313/584
5,757,131 5/1998 Tsuchiya ..... 445/24

FOREIGN PATENT DOCUMENTS 61-24126 2/1986 Japan .
4-47639 2/1992 Japan .

*Primary Examiner*—Kenneth J. Ramsey
*Attorney, Agent, or Firm*—Young & Thompson

[57] ABSTRACT

In a substrate manufacturing process for color plasma displays, it is made possible to form a phosphor coat in a desirable form all over a panel by introducing a step to coat the whole surface of a luminescent display section with a paste containing white particulates of titanium oxide or the like, which are finer than phosphor powder, after barriers are formed on a back substrate and before the discharge cell inside is sequentially coated with phosphors for different colors to make up luminescent pixels. By applying the particulate paste to the unfired barrier portion, which is then in a very porous state, before the phosphor coating stage, collective firing of the barriers and the phosphor layers is made possible.

6 Claims, 5 Drawing Sheets

(PRIOR ART)

MANUFACTURING PROCESS FOR COLOR PLASMA DISPLAY PANELS

BACKGROUND OF THE INVENTION

1. Field of the Invention

The present invention relates to a manufacturing process for color plasma display panels (PDPs), and more particularly to a pretreatment for forming phosphor layers.

2. Description of the Related Art

In a color plasma display panel, gas discharge generates ultraviolet ray to excite three different color phosphor layers respectively coated inside of discharge cells to emit red, green and blue lights for achieving color displaying. FIG. 4 shows a typical panel structure of surface discharge type AC color plasma displays. Inner surface of a front glass substrate 6 is provided with surface discharge electrodes 7, each consisting of transparent conducting films formed by stacking metallic bus electrodes. A transparent dielectric layer or glaze layer 8, is coated on the electrodes 7 and a black matrix 9 is formed on the glaze layer 8 so as to determinate pixels. On a glass substrate 1 on the back side are formed data electrodes 2, a glaze layer 3, and striped white barriers 4. Phosphor 5, alternately colored in red, green and blue, is disposed over the side faces of the white barriers 4 and groove bottoms between them, which together constitute a discharge cells.

Discharge gas is sealed into the space between the two glass substrates to complete a panel. To scanning electrodes are successively applied scanning pulses and, in synchronism with them, data pulses are applied to selected data electrodes. After this line-by-line successive scanning has covered the whole panel, sustaining discharge is caused to take place all over the panel to achieve color luminescence. This operation is accomplished in a plurality of subfields each having a prescribed frequency of luminescence corresponding to digitized gradation data in a field period of 1/60 of a second to display color pictures of television of the like.

In the manufacturing process of such a panel, the process of forming finely patternized phosphor layers is of critical importance. Where a phosphor coat is to be formed over a flat substrate, with no protruding barriers on it, a satisfactory layer can be formed by exposing to light and developing phosphor patterns, each corresponding to one or another of the three primary colors.

However, this method cannot be readily applied where barriers are formed and a phosphor layer has to be formed on the side surfaces of the barriers, too, as in the structure illustrated in FIG. 4. To such a case, a screen printing process is applied, whereby a screen having striped openings of three times as high a pitch as the striped cells are used, and the inner surface of the cells are coated through the screen meshes with a paste containing a binder and a solvent. This process is repeated with a drying process in-between to form phosphor layers of three colors. Apart from this method, application with a fine dispenser is also proposed.

Whereas the pixel size of a color plasma display varies with the screen size and the use, the pitch of barriers ranges from 130 to 500 microns for a television or personal computer monitor panel measuring from 20 to 60 inches diagonally, i.e. the main applicable range of color plasma displays. The barriers are from 100 to 200 microns high and from 30 to 100 microns wide, and this means that the phosphor layers need to be formed over the bottom of discharge cells and the side faces of barriers of a high aspect ratio, which make up narrowly limited spaces between them.

The bottom surface of the discharge cells is a high dense structure, such as a glass substrate, a metallic electrode or a glaze layer. The barriers are finely processed by applying a thick film processing technique, such as sand blasting, to a paste layer consisting of a mixture of the powder of an oxide, such as alumina, and glass having a low melting point, and firing the product of this process at high temperature. As the glass content is kept low to minimize the deformation by firing, the barrier portion is often porous. Though it is conceivable to simplify the process by firing the barriers at a time after their coating with phosphor, but the barriers portion not yet fired but only dried is highly porous and accordingly not strong enough.

Since the structure to which phosphor paste is to be applied is variable in absorptiveness, surface roughness and other respects, the state of coating is made all the more susceptible to unevenness between the bottom and the barrier sides. Moreover, the shape of the phosphor coat may differ with the sequence of phosphor application. While discharge cells on both sides of the first applied phosphor are uncoated with phosphor, the second and third find phosphor coating on either side and both sides, respectively. The influence of this state of the adjoining cells is particularly significant when the barriers are porous, and the sequence of coating may give rise to uneven presence of phosphor or a difference in the amount of coating between the barrier sides and the bottom.

FIG. 5 schematically illustrates the cross-sectional shapes of a phosphor coat 5 over a substrate 1 having barriers 4. While FIG. 5A shows a satisfactory state, FIG. 5B shows coating of only the bottom, and FIG. 5C, an extreme case in which phosphor is lumped over the middle part of the bottom. In the example of FIG. 5D, conversely, the sides of the barriers 4 are thickly, but their bottom is scarcely, coated. Uneven coating, such as the case of FIG. 5E, would involve the trouble of substantial fluctuations in brightness when the screen is looked at obliquely.

These uneven distributions of phosphor would affect not only the drive performance of the color plasma display but also the distributions of tint, brightness and visual angle-dependence over the area of the panel. Since human sight is sensitive to these distributions, it is of vital importance to achieve a sufficiently uniform state of phosphor coating for the three primary colors over the whole area of the panel display screen.

Delicate adjustment and sophisticated coating control of phosphor paste have been attempted only to invite a drop in the yield and a rise in the cost of panel manufacture. Firing of the barrier portion together with the phosphor coat, instead of firing it in advance, has an advantage for the manufacturing process as it serves to simplify the process and makes possible protection of the substrate from thermal deformation during the barrier firing, but this simplified process has been prevented from practical use by its inability to apply phosphor with a satisfactory result.

SUMMARY OF THE INVENTION

An object of the present invention, therefore, is to provide a manufacturing process for color plasma display panels having barriers, whereby, after the barriers are formed over a substrate, the inner surface of discharge cells including the barrier sides, which would constitute the luminescent display area, is coated all over with a paste mainly consisting of particulates of a white inorganic material before it is sequentially coated with phosphors for different colors, and dried after the phosphor coating.

The invention also provides a manufacturing process for color plasma display panels having barriers, whereby, after the barriers are formed by firing, the luminescent display section is coated all over with a paste mainly consisting of particulates of a white inorganic material, dried, sequentially coated with phosphors for different colors, and dried again, followed by collective firing of the luminescent display section including the barrier portion as well.

It is also possible to uniformly cover the discharge cell inside by coating, before applying the phosphor paste, the bottom of light emitting cells and the barrier portion all over with a paste of particulates smaller than the grains of phosphor, such as titanium oxide particulates, by screen printing or otherwise. This layer, because it consists of fine particulates, firmly sticks after it is dried. This treatment enables both the barrier portion and the bottom to be covered by a uniform surface layer of proper absorptiveness, and accordingly serves to substantially improve the uniformity of phosphor paste coating at the next stage.

BRIEF DESCRIPTION OF THE DRAWINGS

The above-mentioned and other objects, features and advantages of the present invention will become more apparent from the following detailed description when taken in conjunction with the accompanying drawings, wherein.

DETAILED DESCRIPTION OF THE PREFERRED EMBODIMENTS

Figure 1A:
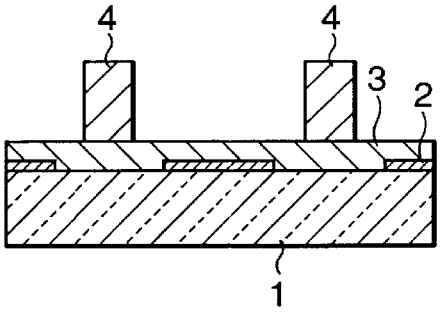
FIG. 1 shows cross-sectional views at different stages of the manufacturing process according to the present invention in its first preferred embodiment.
Figure 4:
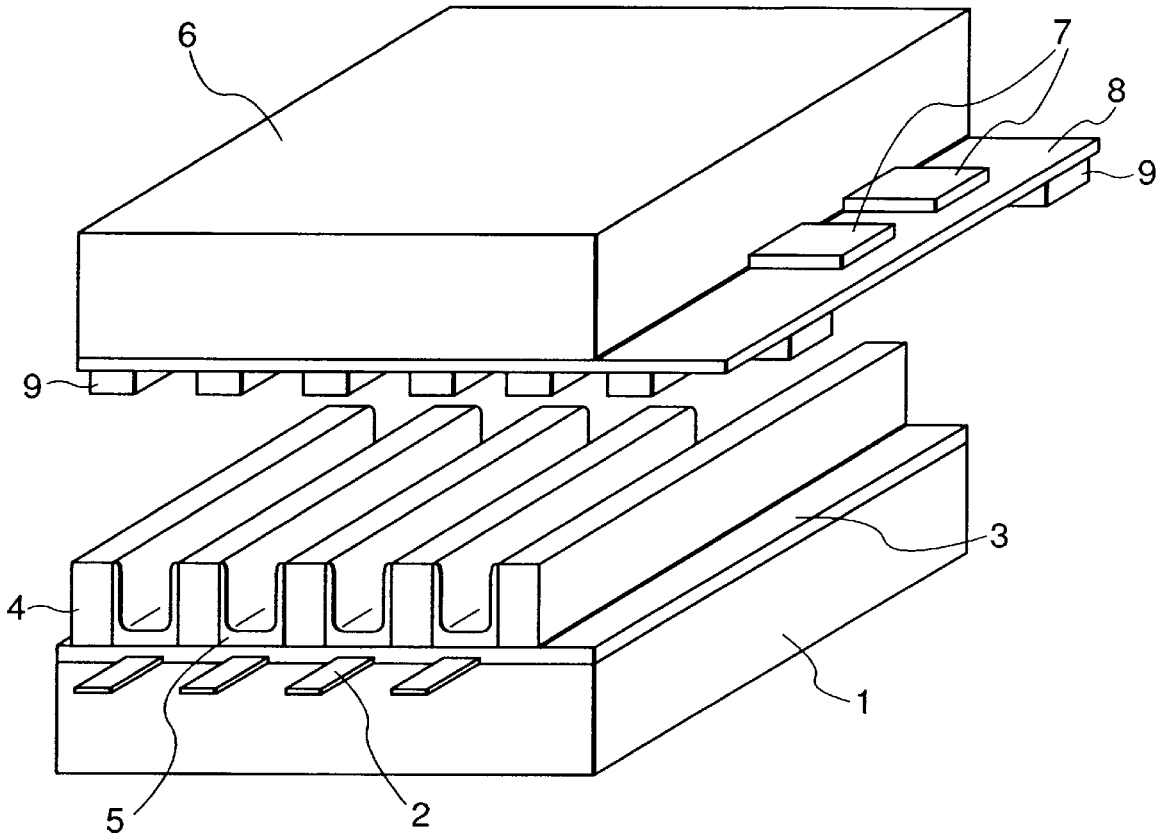
FIG.4 (PRIOR ART)
FIG. 4 shows an exploded perspective view of the prior art structure of a color plasma display.
Figure 5A:
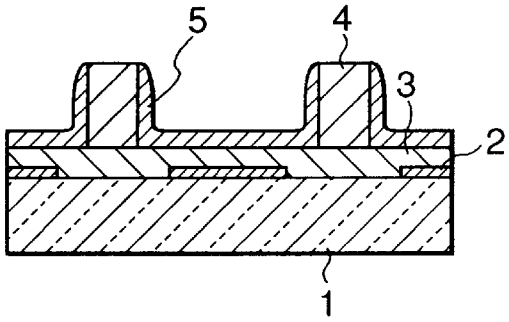
FIG. 5 shows cross-sectional views of different states of phosphor coating according to the prior art.
Figure 5B:
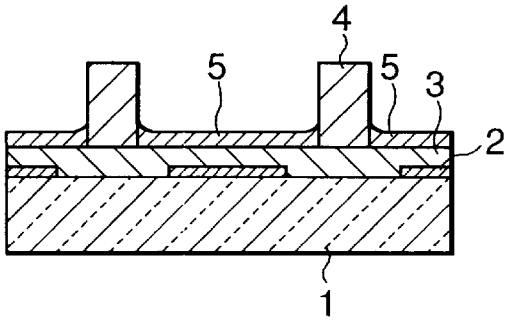
Figure 5C:
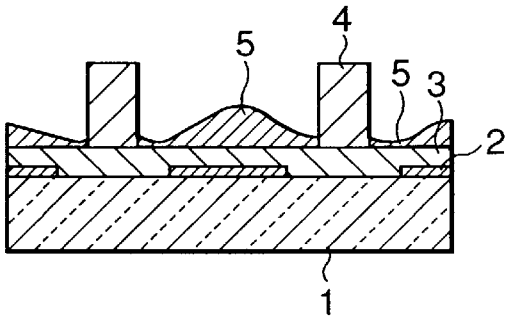
Figure 5D:
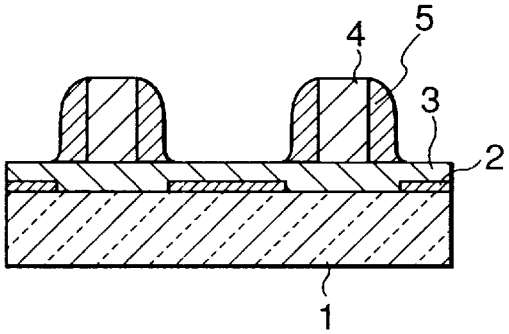
Figure 5E:
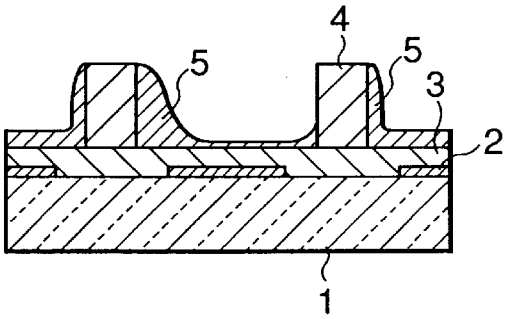

A first preferred embodiment of the present invention will be described with reference to the back substrate fabricating stage of a surface discharge type AC plasma display such as shown in FIG. 4. After data electrodes 2, each consisting of a thick silver film laid over a glass substrate 1, have been formed at a repetitive pitch of 350 microns, the whole surface is coated by screen printing with a glaze glass paste mainly consisting of low melting point glass powder, followed by drying, and a glaze layer 3 is formed by firing. Then, after another paste layer for barriers 4, comprising alumina powder, low melting point glass powder, binder and solvent, is formed by repeated screen printing to a thickness of about 200 microns, a dry film is laminated over its surface, exposed to light and developed. With the parts of the dry film left in correspondence to the barrier pattern being used as mask, a barrier portion of a high aspect ratio is formed by sand blasting. After the dry film is stripped, the barrier portion 4 is fired at about 550° C. to give the back substrate 1 with firm barriers 4 as illustrated in FIG. 1A. The barriers 4 are about 80 microns wide and about 150 microns height.

Figure 1B:
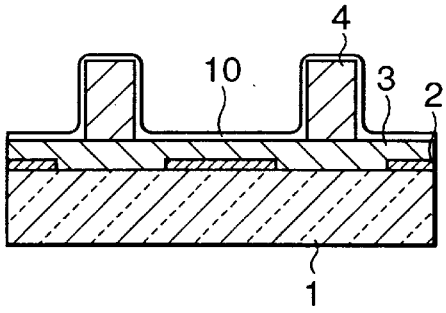

Then, the display section is coated all over by screen printing with a paste mainly consisting of fine powder of titanium oxide of about 0.2 micron in grain size, and dried. As illustrated in FIG. 1B, a layer or finely pulverized titanium oxide is formed all over the discharge cell bottom and the sides and top of the barrier 4. The layer sticks firmly as it is composed of extremely fine powder.

Figure 1C:
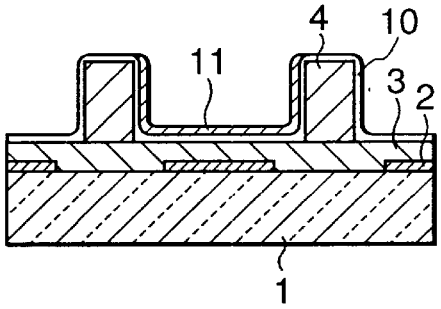
Figure 1D:
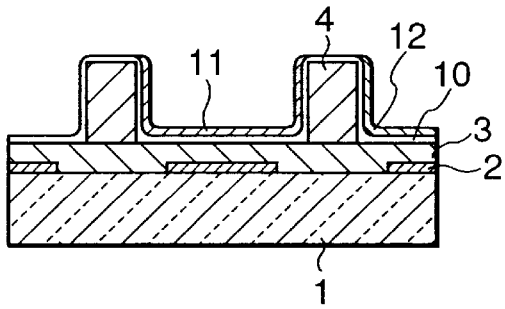
Figure 1E:
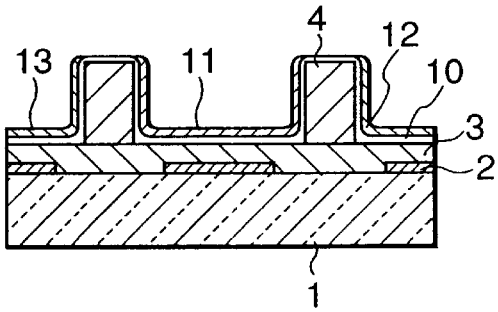
Figure 1F:
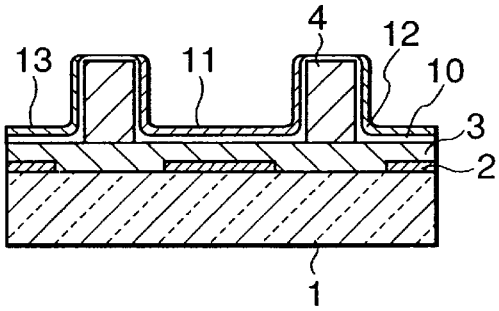

Next, a paste of red light-emitting phosphor is printed using a screen having thin slits, and dried (FIG. 1C). A similar step is repeated for green light-emitting phosphor (FIG. 1D) and for blue light-emitting phosphor (FIG. 1E). The product of this series of printing is fired to decompose and burn the binder, and the phosphor mounting process is thereby completed (FIG. 1F).

Figure 3A:
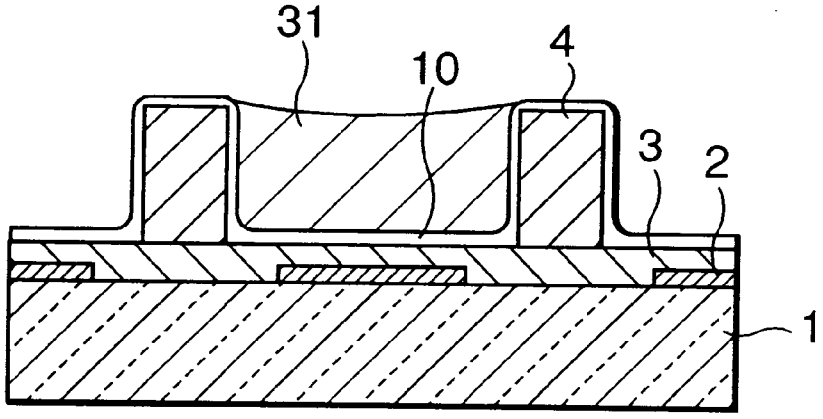
FIG. 3 shows cross-sectional views of the state in which phosphor paste coating is applied and that in which it has been dried.
Figure 3B:
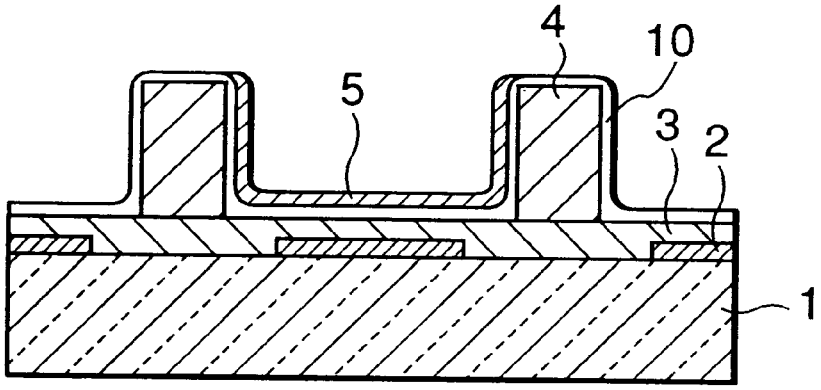

The effect of the finely pulverized titanium oxide layer in the embodiment is schematically illustrated in FIG. 3. FIG. 3A shows the state immediately after a groove, which would constitute a discharge cell, is coated with a green phosphor paste 31. It is seen that the groove is filled with the green phosphor paste 31. As the the paste dries, a phosphor layer 5 is formed to cover the layer 10 of finely pulverized titanium oxide evenly because of the intervening presense of the fine powder layer 10 which is absorptive in every part and consonant with the phosphor paste. As the grain size of the titanium oxide particles is far smaller than that of the phosphor, the phosphor powder never enters into and mix with the layer 10 of finely pulverized titanium oxide. The titanium oxide layer 10 is about 10 microns thick, and the phosphor layer is about as thick. Thus is a color plasma display panel completed by combining the back substrate 1 over which phosphor layers 11, 12 and 13 for three colors are formed in a satisfactory state of coating with a front substrate 6 over which surface discharge electrodes 7, among other things, are formed, and purging air from the inner space and sealing discharge gas into it.

Figure 2A:
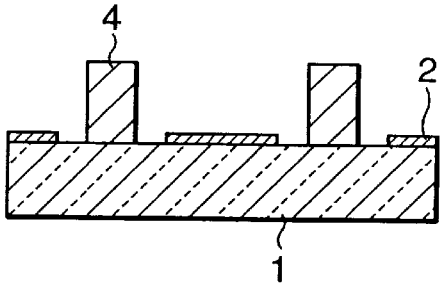
FIG. 2 shows cross-sectional views at different stages of the manufacturing process according to the invention in its second preferred embodiment.

Next will be described a second preferred embodiment of the invention, wherein the firing stage is simplified by collective firing. After data electrodes 2 are formed over a glass substrate 1, a dry film is laminated into a form which would serve as matrix of barriers 4, then exposed to light and developed. This dry film groove is coated with a paste for the barriers 4 and, after the paste is dried, the barrier portion is formed by an additive method to strip the dry film (FIG. 2A).

Figure 2B:
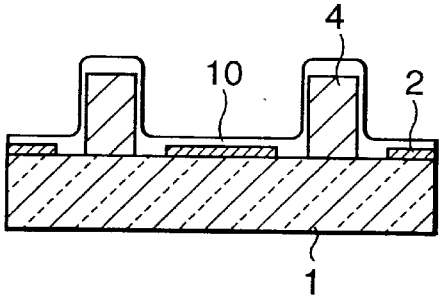
Figure 2C:
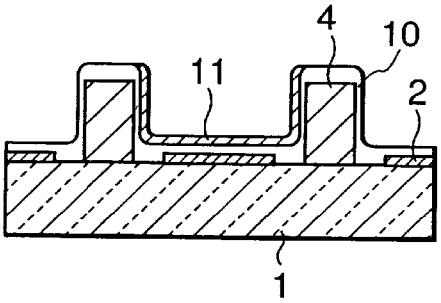
Figure 2D:
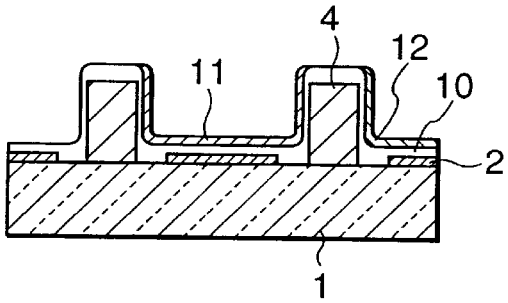
Figure 2E:
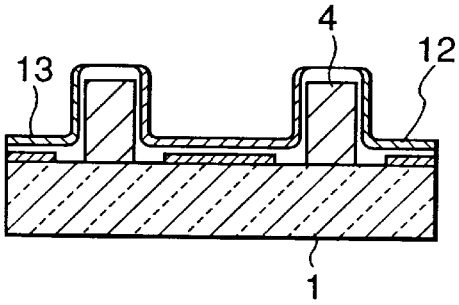
Figure 2F:
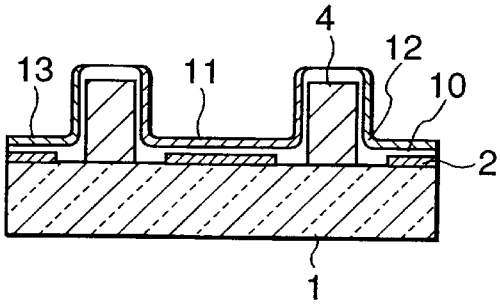

Then, after the whole display surface is coated by screen printing with a paste of finely pulverized titanium oxide and this layer 10 is dried (FIG. 2B), the application and drying of phosphor paste layers 11, 12 and 13 are accomplished by the same method as in the first embodiment (FIG. 2C through FIG. 2E). After that, this intermediate product is put into a firing oven for barrier firing and removal of binder from the titanium oxide layer 10 and the phosphor layers 11, 12 and 13 to complete the part of the back substrate fabrication process until the formation of the phsophor layers 11, 12 and 13 (FIG. 2F).

In this embodiment, the constituent of the barriers 4 before the phosphor paste applying stage is in a state in which alumina powder or the like and low melting point glass powder are merely fastened together by a binder, is highly porous and has a high resin content, which makes up the binder. It accordingly greatly differs in character from the bottom structure which consists of a glass surface and data electrodes among other things.

Therefore, if there is no coating with a particulate layer 10 unlike in the present invention, phosphor may more or less concentrate on the sides of barriers 4 or distribute unevenly depending on the sequence of phosphor application, resulting in difficulty to form a phosphor coat in a satisfactory shape. In an even worse case, the barriers 4 may fall or be displaced during the application or drying of phosphor because, as phosphor is applied to every third discharge cell groove, the barriers 4 are subject to filling with phosphor and its drying and contraction on only one side.

On the contrary in this embodiment, as titanium oxide paste is applied all over, no uneven horizontal force works on the barrier portion 4, which is accordingly subject to no adverse effect. Moreover, there is a further effect of the particles of titanium oxide to infiltrate into the void space of the barrier portion 4 and strengthen it. These effects make possible collective firing of the barriers 4 together with the phosphor layers 5 and simplification of the firing procedure as a result. Furthermore, since the barrier portion 4 is not fired by itself and accordingly the substrate 1 is not deformed by firing, the accuracy of phosphor coating is improved.

Although fine powder of titanium is used for the particular layer 10 in the above-described embodiment, it need not be titanium oxide but may as well be another material such as alumina, silicon oxide, magnesium oxide, barium oxide, tin oxide or zinc oxide, or a mixture of some of them. It need not be white particulates, but whiteness is preferable in respect of the effect of its reflection to enhance brightness.

Though there is no need to be very strict about the grain size of the particulates to be used, they should preferably be as fine as practicable from the viewpoint of uniform applicability and film strength. Since the grain size of phosphor powder is from 2 to 5 microns, in order to ensure uniform application of phosphor, it is preferable for the particulates to be sufficiently finer than the phosphor. Particulates of 1 micron or less in grain size would be effective enough.

If the particulate layer 10 is too thin, it will not be sufficiently effective as an undercoat or, if it is too thick, phosphor coating may be affected because the liquid content of phosphor paste, when it is applied, would be quickly absorbed by the particulate layer 10. There would be an additional disadvantage that the discharge cell space, which is secured by the barrier height, is reduced. Therefore, the thickness of the particulate layer 10 should desirably be not less than 3 microns but not more than 40 microns. Whereas particulates of titanium oxide are used in the above-described embodiments, they are massively used by industry and inexpensive. The layer of titanium oxide particulates would be effective enough at a thickness of about 10 microns, and the embodiments are supposed to use a paste composition which would result in a layer thickness of about 8 to 15 microns.

Although the particulate layer 10 is formed by screen printing in the above-described embodiments, the applicable method of its formation is not limited to screen printing. To further improve coverage and reflection, a plurality of particulate layers 10 may be formed one over another, and in this case the individual layers may differ in material and grain size. The layer can be painted with a blade or a roller, or as well be sprayed. The method of forming the phosphor layers 5, too, is not limited to screen printing, but may be metal mask printing, or a dispenser may be used in different manners for different layers. Though the embodiments represent application to a surface discharge type AC plasma display, the applicability of this manufacturing process is not restricted to plasma displays of this type, but also covers manufacturing processes for otherwise structured AC plasma displays, DC plasma displays and other plasma display panels having reflective phosphor layers including barrier sides.

As hitherto described, the present invention makes it possible to readily form phosphor layers for three primary colors in a desirable coat shape over the whole surface of a panel by forming a particulate layer before coating with the phosphor layers, and thereby serves to improve the uniformity and brightness of luminescent displaying. Furthermore, it makes possible collective firing of the barrier portion and phosphor layers, and can thereby contribute to reducing the manufacturing cost of panels.

A major secondary effect of the manufacturing method according to the invention consists in the use of highly reflective particulates, such as those of titanium oxide, for the particulate layer 10, which serves to improve brightness and reduce the thickness of the expensive phosphor layers. While the advantage of a double-layered structure having a highly reflective particulate layer and a phosphor coat is already disclosed in the Japanese Patent Laid-open No. Hei 4-47639, the manufacturing method according to the present invention enables a structure having a highly reflective layer, including the sides of barriers, to be realized with remarkable ease.

What is claimed is:

1. A manufacturing process for color plasma display panels having barriers, comprising:

a step of forming a plurality of barriers on a substrate;

a step of coating a paste layer mainly consisting of particulates of an inorganic material on said substrate and top and side surfaces of said barriers;

a step of drying said paste layer to form reflective layer; and a step of forming phosphor layers on said reflective layer except for top surfaces of said barriers.

2. A manufacturing process according to claim 1, further comprising a step of forming a glaze layer on said substrate prior to forming said barriers.

3. A manufacturing process according to claim 1, wherein said barriers, said reflective layer and said phosphor layers are fired simultaneously.

4. A manufacturing process according to claim 1, wherein grain size of said inorganic material particulates is smaller than that of phosphor powder of said phosphor layer.

5. A manufacturing process according to claim 1, wherein said inorganic material particulates consist of a highly reflective material having a high refractive index to show a white color.

6. A manufacturing process for color plasma display panels having barriers comprising:

a step of forming a barriers portion which is turned into barriers by firing;

a step of coating a luminescent display area all over with a paste mainly consisting of particulates of a white inorganic material and drying the paste;

a step of sequentially applying and drying phosphors for different colors; and a step of collectively firing the barrier portion, the inorganic material particulate layer and the phosphor layers.

* * * * *